US006678980B2

(12) United States Patent
Arias

(10) Patent No.: US 6,678,980 B2
(45) Date of Patent: Jan. 20, 2004

(54) TRAFFIC SAFETY SIGN APPARATUS

(76) Inventor: Anthony R. Arias, 922 University Blvd., Silver Spring, MD (US) 20903

( * ) Notice: Subject to any disclaimer, the term of this patent is extended or adjusted under 35 U.S.C. 154(b) by 36 days.

(21) Appl. No.: 09/949,019

(22) Filed: Sep. 10, 2001

(65) Prior Publication Data

US 2003/0046841 A1 Mar. 13, 2003

(51) Int. Cl.[7] ..... G09F 13/20
(52) U.S. Cl. ..... 40/542; 40/570
(58) Field of Search ..... 40/542, 550, 570; 362/34

(56) References Cited

U.S. PATENT DOCUMENTS 2,509,707 A * 5/1950 Taylor ..... 40/570
2,524,294 A * 10/1950 Marsh ..... 40/552
4,016,450 A * 4/1977 Balekjian ..... 40/542 X
4,202,123 A * 5/1980 Witt ..... 40/596
4,724,629 A * 2/1988 Walton ..... 40/550 X
4,772,986 A * 9/1988 McNemor ..... 362/34 X
5,406,463 A * 4/1995 Schexnayder, Sr. ..... 40/542 X
5,607,222 A * 3/1997 Woog ..... 40/542 X
5,722,760 A * 3/1998 Chien ..... 40/552 X
5,899,009 A * 5/1999 Fisher ..... 40/542

* cited by examiner

*Primary Examiner*—Joanne Silbermann
(74) *Attorney, Agent, or Firm*—Alfred F. Hoyte, Jr.

(57) ABSTRACT

An emergency traffic sign apparatus for vehicles which has at least three power sources. The emergency sign has a substantially planar main body, on which indicia, preferably in the form of an arrow or other direction indicating symbol is printed in outline form. A cavity formed in the main body contains a secondary light source such as a flourescent or incandescent bulb. Power for the light source is supplied by a vehicle lighter adapter or other means for providing power from a vehicle battery. A self contained emergency battery source provides power in the event vehicle battery power is not available. Primary lighting for the traffic sign is provided by a chemiluminescent light stick which is placed within a tube which is aligned with the cavity containing the secondary light source. The tube within which the primary light source is contained is transparent, and may contain reflectors or optics to modify the light output of the chemiluminescent light stick.

4 Claims, 1 Drawing Sheet

TRAFFIC SAFETY SIGN APPARATUS

BACKGROUND OF THE INVENTION

The present invention relates to traffic safety signs. More particularly, it relates to an emergency sign for an automotive vehicle which can be used to alert oncoming traffic of a disabled vehicle.

STATEMENT OF THE PRIOR ART

Numerous types of emergency signaling devices sized for convenient storage in an automotive vehicle are currently available. These devices generally fall into two categories. The first type are passive, reflective devices such as traffic cones and triangles. The others are illuminated "active" devices such as flares or boards having illuminated indicia formed thereon. Most of the active devices are either electrically powered, using power from the vehicle battery, or illuminated by luminescent chemicals such as Cyalume®. The primary drawback to these systems is that the electrically powered systems depend upon either the vehicle battery or internal batteries solely for power. The problem with relying on the vehicle battery is that the battery is drained and may render the vehicle incapable of starting after the emergency situation has been resolved. Also, the vehicle battery failure could even be the cause of the emergency. Systems requiring internal batteries are subject to the effects of long term storage, which includes not only low battery batteries due to long term drainage, but also, battery leaks which can damage or corrode the electrical contacts within the device, rendering the same inoperable even if fresh batteries are available.

Systems operating solely from chemiluminescent light sticks suffer from the drawback in that the light sticks only last a few hours after which time the stick must be replaced. Accordingly, it would be desirable to provide a traffic warning system which can remain illuminated for long periods of time which employ multiple light sources.

U.S. Pat. No. 5,269,251 issued to Freeman discloses a traffic cone which is modified to receive a chemical light stick. To provide illumination at night or during periods of poor lighting conditions the light stick is placed into an adapter receptacle in the cone. A thimble like adapter is provided to fit into the top opening of the adapter, with the open end of the thimble adapter pointing upwards so as to provide a convenient snap fit for one end of the chemical light stick after said light stick has been bent and shaken to mix its chemical contents, thereby producing light. Freeman, however, makes no mention of any type of alternative lighting arrangement.

U.S. Pat. No. 5,406,463 issued to Schexnayder discloses an octagonally-shaped, orange colored sign display (10) having intelligible, informational indicia (20) thereon, such as "CALL 911," using chemi-luminescence to provide illumination from within the indicia in emergency situations. The indicia consist of a series of separate, hollow, formed containers, which are made of at least translucent, if not transparent, material and contain a special, generally isolated chemical, which is ultimately mixed with another special chemical located in an upper, horizontally disposed, reservoir tube (30/330), with the tube connected to the indicia containers by connector lines (40). A membrane divider (31/331) extends across the bottom portion of the reservoir tube, isolating the upper chemical from the lower chemical, until steps are taken to break or rupture it. The two chemi-luminescent chemicals are mixed by breaking the membrane by bending the tube until the membrane breaks. The chemi-luminescent reaction causes the indicia to brightly stand out against the background of the display due to their internal illumination and thereby be highly visible or noticeable, as well as easily intelligible, to passing motorists or other passers-by. The reservoir and individual indica can be made from transparent plastic tubes, with the latter being made in the form of the desired lettering of the indicia, with a separate, horizontally disposed reservoir being provided for each line of lettering. In an alternative embodiment (FIGS. 4–6) both chemicals are contained in a dual compartmented, replaceable reservoir which snaps onto the tops of the indicia and, thereafter, on activation flow into the indica to internally illuminate them. Schexnayder also does not address the problem of limited duration of chemical light sticks.

None of the above inventions and patents, taken either singly or in combination, is seen to describe the instant invention as claimed.

SUMMARY OF THE INVENTION

The present invention overcomes the disadvantages of the prior art by providing an emergency traffic sign apparatus for vehicles which has at least three power sources. The emergency sign has a substantially planar main body, on which indicia, preferably in the form of an arrow or other direction indicating symbol is printed in outline form. A cavity formed in the main body contains a secondary light source such as a flourescent or incandescent bulb. Power for the light source is supplied by a vehicle lighter adapter or other means for providing power from a vehicle battery. A self contained emergency battery source provides power in the event vehicle battery power is not available. Primary lighting for the traffic sign is provided by a chemiluminescent light stick which is placed within a tube which is aligned with the cavity containing the secondary light source. The tube within which the primary light source is contained is transparent, and may contain reflectors or optics to modify the light output of the chemiluminescent light stick.

Accordingly, it is an object of the invention to provide an illuminated traffic safety sign for automotive vehicles.

It is another object of the invention to provide an illuminated traffic safety sign for automotive vehicles having multiple sources of power and illumination.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
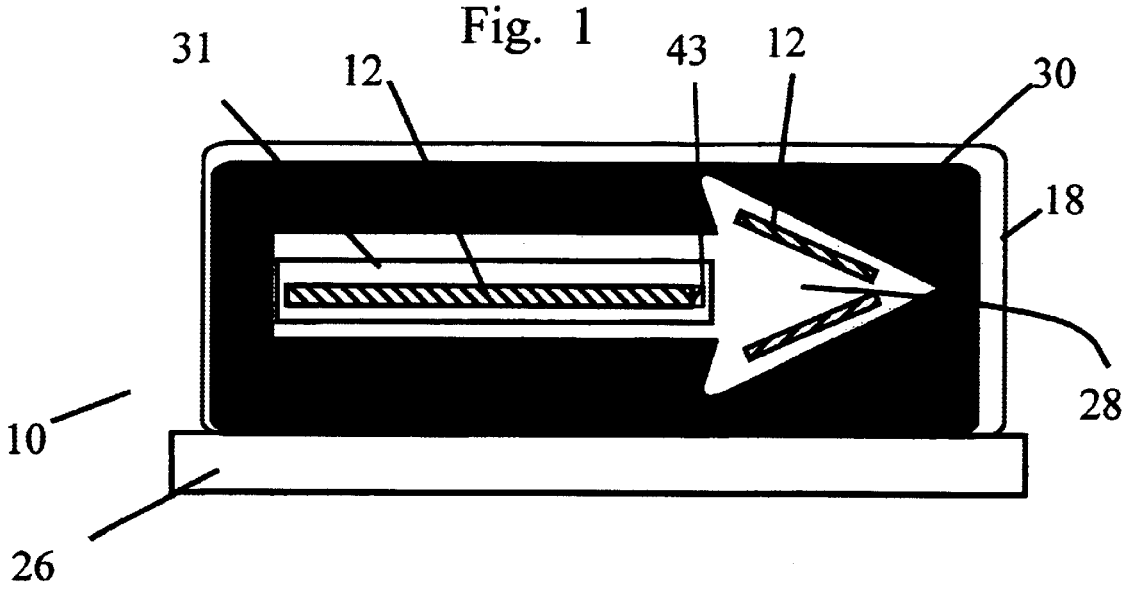
FIG. 1 shows a front view of the traffic safety sign apparatus of the present invention.
Figure 2:
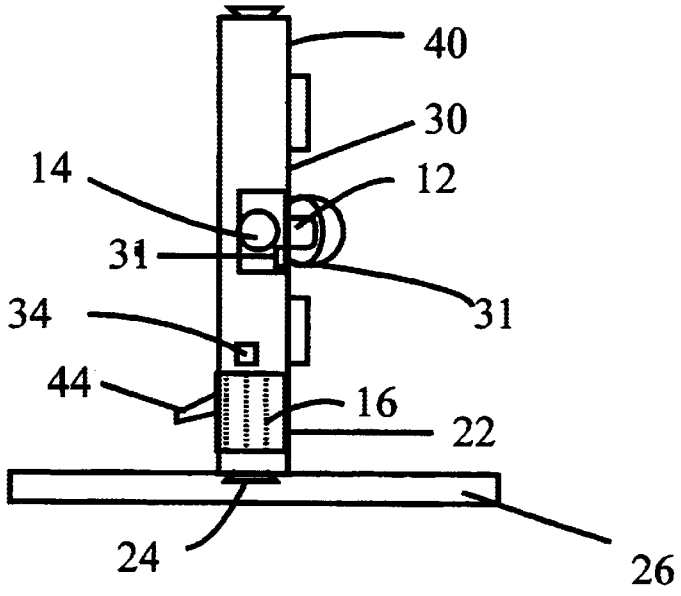
FIG. 2 shows a side view, partly in section, of the traffic safety sign apparatus of the present invention.

Referring now to FIGS. 1 and 2, the apparatus of the present invention, generally indicated by the numeral 10, is shown. The traffic safety sign apparatus 10 is designed primarily for use with automotive vehicles, and utilizes three sources of power for providing illumination. To provide illumination at night or during periods of poor lighting conditions, self powered chemical light sticks 12 (e.g. Cyalume Light Stick, made by American Cyanamid Company, Chemical Light Department, Milton, Fla. 32570. Cyalume is a registered trademark of American Cyanamid Company.) can be employed. Secondary light source such as a flourescent or incandescent light bulb 14 utilizes a vehicle battery (not shown) for electrical power. A third source of power for illuminating the apparatus 10 is a self contained power pack 16 which may be alkaline batteries or rechargeable nickel cadmium batteries.

A substantially planar main body 18 has a first cavity 20 formed therein for containing the secondary light source 14, and a second cavity 22 for containing the power pack 16. A pair of opposing, outwardly projecting flanges 24 are shaped for sliding and locking frictional engagement within a correspondingly shaped groove 25 formed in a base 26 which supports the main body 18 in an upright position. Base 26 includes attachment means, preferably in the form of a magnet, for attaching the apparatus 10 to a vehicle roof or trunk. The base 26 may be designed and appropriately sized to contain a stand (not shown), preferably of the collapsible type, which would allow suspension of the apparatus 10 a few feet above the ground. Indicia 28, which may be in the form of an arrow as shown in FIG. 1, is imprinted on the front face 30 of the main body 18. Other indicia may be imprinted on the front face 30 such as alpha numeric characters, e.g., "HELP", "EMERGENCY", etc. A light sensing means 32 is preferably placed in the proximity of the light stick 12 to control the illumination of the secondary light source 14 in combination with an electronic control system 34 as will be explained in more detail later.

In order to provide effective illumination from both the light stick 12 and the secondary light source 14, portions of the apparatus 10 must be made transparent or translucent. The front panel 40, which includes the front face 30, has transparent sections 31 through which illumination from the secondary light source 14 is projected. The transparent sections 31 correspond to the shape of the indicia 28. It should also be noted that the cavity 20 within which light source 14 is contained extends under all of the characters of the indicia 28, the number and shape of the light sources 14 being chosen to ensure effective lighting behind all of the indicia 28. A transparent receptacle 42 contains each of the light sticks 12, the receptacle being optically shaped so as to gather and magnify illumination emitted from either the light stick 12 or the secondary light source 14. Closure members 43 may be added at one or both ends of receptacles 42 to prevent accidental dislodging of the light sticks.

In a preferred embodiment, a lighter adapter unit (not shown) may be provided to work in combination with power pack 16 to provide electrical power to light source 14. The control circuit 34 may be programmed to monitor and detect low voltage from the lighter adapter unit, and automatically switch to power pack 16. An on/off switch 44 switches power to the control circuit 34 and the light source, the control circuit including switching means for selectively applying power to the secondary light source 14.

In operation, the light sticks 12 are activated and placed within the receptacles 42, which has an opening formed in one end. The switch 44 is placed in the on position. Closures may be provided on the ends of receptacles 42 to ensure each of the light sticks 12 remains in place. Once the light sticks 12 are activated the assembly 10 may be placed on the roof, trunk, or other area of the vehicle. Alternatively, the optional stand (not shown) may be deployed to position the apparatus 10 several feet behind the vehicle to provide advance warning to oncoming traffic. The orientation of the indicia 28 is determined by slidably engaging the appropriate one of the pair of flanges 24 within groove 25 of the base 26. When the sensor 32 detects low light levels emanating from the light sticks 12, control circuit 34 sends control signals to activate the secondary light source 14, utilizing power pack 16 or the vehicle battery to provide electrical power to the secondary light source. The control circuit 34 may be programmed to prioritize use of power pack 16 to provide operating voltage, saving the vehicle battery power until absolutely needed.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. An emergency traffic sign apparatus comprising:

a substantially planar main body having a hollow interior defined by a plurality of panel sections, said sections including a front panel having a plurality of substantially linear, transparent regions for allowing light from an electrically powered light source contained within said hollow interior to pass therethough;

said transparent regions collectively forming indicia;

transparent receptacles placed over said transparent regions and aligned therewith, each of said receptacles removably containing a self powered luminescent member, said receptacles having at least one opening, the opening having an associated closure to allow for selective removal or containment of said self powered luminiscent member; and a base releasably attached to said main body for supporting said main body in an upright position.

2. The apparatus of claim 1 wherein said first cavity contains a light source sufficiently luminous to project light through said transparent regions to illuminate said indicia.

3. The apparatus of claim 1 wherein a sensing means is placed proximate said self powered luminescent member, said sensing means capable of measuring light intensity of said self powered luminescent member.

4. The apparatus of claim 1 wherein said transparent receptacle includes optics for imaging light coming from both said self powered luminescent member and said electrically powered light source.

* * * * *